United States Patent [19]

Bittle

[11] 4,204,577

[45] May 27, 1980

[54] GOLF HOLE CUTTER GUIDE

[76] Inventor: L. Dalton Bittle, 3208 Jamestown Rd., Hattiesburg, Miss. 39401

[21] Appl. No.: 932,600

[22] Filed: Aug. 10, 1978

[51] Int. Cl.[2] ..... A63B 57/00

[52] U.S. Cl. ..... 172/25; 294/50.7; 30/130

[58] Field of Search ..... 172/25, 13, 22, 26; 294/59, 50.5, 50.7; 30/130, 124

[56] References Cited

U.S. PATENT DOCUMENTS

| | | | |
|---|---|---|---|
| 1,340,927 | 5/1920 | Whitman | 172/25 X |
| 1,548,865 | 8/1925 | Bull | 294/50.7 |
| 2,531,297 | 11/1950 | Rose | 172/22 |
| 3,558,385 | 1/1971 | Ronning | 30/130 |
| 3,927,720 | 12/1975 | Rauch | 172/22 |

OTHER PUBLICATIONS

Par Aide Products Catalog, p. 9, 1961.

*Primary Examiner*—Richard J. Johnson
*Attorney, Agent, or Firm*—Dowell & Dowell

[57] ABSTRACT

An apparatus for guiding a golf hole cutter when constructing holes on a golf putting green in such a manner that the ground surrounding the hole remains level and the area surrounding the hole is protected from markings and indentations caused by the feet of the greenskeeper.

1 Claim, 4 Drawing Figures

GOLF HOLE CUTTER GUIDE

SUMMARY OF THE INVENTION

This invention relates generally to apparatus for the upkeep of golf course greens and is embodied particularly in an apparatus for guiding a hole cutter while constructing a hole or cup into which a golf ball must be played. In the past a golf cup was relocated periodically on a green so that one area of the green would not receive constant wear, as well as to position the cup in a location commensurate with the ability of the players. In other words, a cup on a public golf course normally is located in a relatively wide level area, while a cup used in tournament play by professional golfers may be located in a relatively small area of the green and adjacent to a trap or the like.

Normally when a golf cup is changed from one location to another, a generally cylindrical hole cutting tool is positioned in a desired location after which the greenskeeper tries to maintain the cutter perpendicular to the surface while forcing the cutter into the ground. When the cutter has been inserted to a depth which the greenskeeper judges to be correct, the cutter tool is removed and takes with it a plug of earth and grass and leaves a hole in the green. The cup is removed from the existing hole and is inserted into the new hole while the plug of earth and grass is placed within the hole from which the cup was removed. Ideally the plug of earth and grass will exactly fill the hole from which the cup was removed so that the putting surface is substantially smooth.

In the present device an apparatus is provided having a relatively flat base with an upstanding sleeve mounted generally centrally thereof so that the greenskeeper may stand on the base while the sleeve guides the cutting tool in such a manner that the tool remains perpendicular to the putting surface. When the cutting tool is retracted, the base surrounding the hole prevents upward movement of the earthen lip surrounding the hole and thereby prevents the formation of a ridge which tends to divert the path of the ball.

It is an object of the invention to provide an apparatus for guiding a golf hole cutter which includes a base for protecting the surface adjacent to a hole as well as a sleeve perpendicular to the base for guiding a cutter tool.

Another object of the invention is to provide an apparatus for guiding a golf hole cutter tool in which the guide indicates the depth of penetration of the cutter tool so that the plug of earth and grass which is removed exactly fills an existing hole from which the golf cup has been removed.

DESCRIPTION OF THE PREFERRED EMBODIMENT

Figure 1:
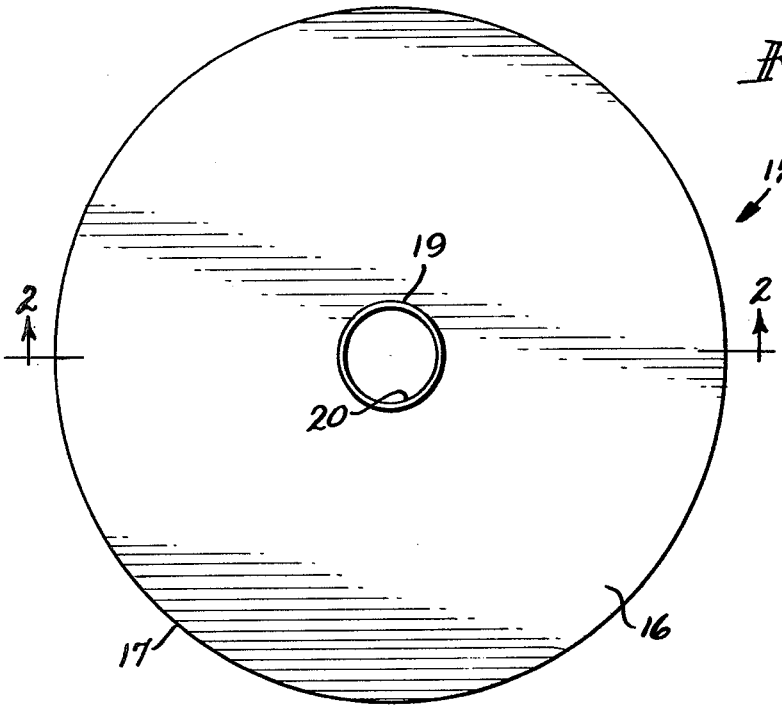
FIG. 1 is a top plan view of the hole cutter guide of the present invention.

With continued reference to the drawing, within the United States, the U.S. Golf Association has established certain standards for play, particularly for tournaments, and these rules state that a golf putting hole or cup must be $4\frac{1}{4}$ inches (107.95 mm) in diameter and 4 inches (101.60 mm) in depth. The upper edge of such cup should be located one inch (25.40 mm) below the putting surface. In order to meet these requirements, a hole cutter tool 10 of conventional construction has been provided which normally has a tubular cutter 11 having an outer diameter of approximately $4\frac{1}{4}$ inches (107.95 mm) and a length of approximately $8\frac{3}{4}$ inches (222.25 mm). The upper end of the cutter is welded or otherwise attached to one end of a post or upstanding rod 12 having a handle 13 at the other end.

Figure 4:
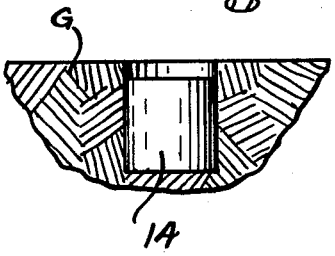
FIG. 4 is a sectional view showing the golf cup in position.
Figure 2:
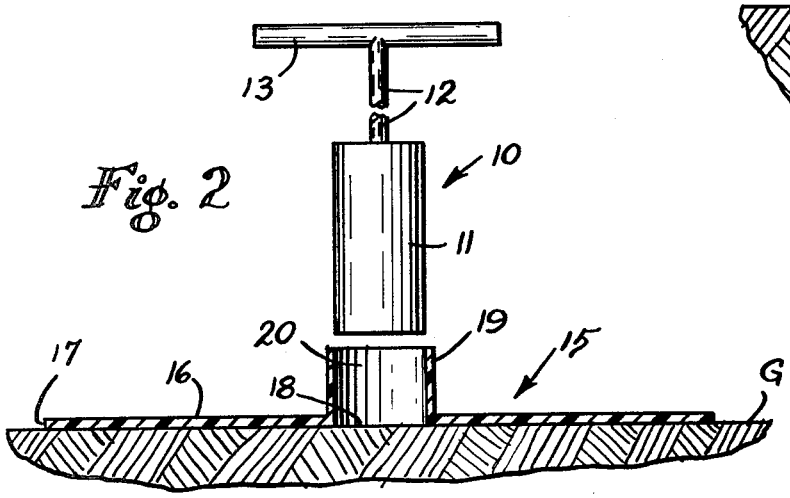
FIG. 2 is a sectional view taken on the line 2—2 of FIG. 1 and illustrating a hole cutter in position to cut a hole.

When a greenskeeper is making a new hole for a cup 14, the cutter tool 10 is positioned generally perpendicular to the putting surface of the golf green G after which the greenskeeper forces the cutter 11 through the grass of the putting surface and the earth until the cutter extends approximately 5 inches (127.00 mm) into the earth at which time the cutter is retracted to remove the plug of earth with the cutter. Thereafter the cup 14 is inserted into the hole (FIG. 4), while the plug of earth within the cutter is transferred to a previous hole and discharged from the cutter so that the previous hole is filled with the upper surface being substantially planar with the surrounding putting surface. Frequently when the cutter tool has been forced into the green G and is being retracted, the upward movement of the cutter causes a ridge to be formed around the lip of the hole and such ridge tends to divert or change the path of movement of a golf ball away from the cup. Also it sometimes happens that the shoes of the greenskeeper make marks or slight indentations in the putting surface of the green when the hole is being formed and such marks also may influence the path of movement of the ball.

In order to assist the greenskeeper to cut a hole which is perpendicular to the putting surface of the green G, as well as to prevent the formation of a ridge adjacent to the hole and marks of the green around the cup, a hole cutter guide member 15 is provided. Such hole cutter guide member 15 includes a flat generally circular disk or base 16 having an outer edge 17 and an opening 18 arranged generally axially of the base. An upstanding guide sleeve 19 is secured to or integrally formed with the base 16 and such sleeve includes an inner peripheral bore 20 which is substantially coextensive with the opening 18. The base 16 and the sleeve 19 may be constructed of any suitable material, such as steel, aluminum or the like in which the sleeve may be welded or otherwise attached to the base, or such base and sleeve may be molded as an integral unit utilizing a thermoplastic material such as polyethylene, polypropalene, polystyrene or the like.

Preferably, the base 16 of the present invention has a diameter of approximately 3 feet (0.9144 m) to prevent any marks or indentations by the shoes of the greenskeeper since the greenskeeper stands on the base when the hole is being formed. The diameter of the bore 20 is slightly larger than the outer diameter of the cutter 11 and preferably is approximately 4 5/16 inches (109.54 mm). The sleeve 19 is perpendicular to the base 16 and, since the base is resting on the putting surface, the sleeve 19 also is perpendicular to such putting surface. The sleeve 19 guides the cutter 11 so that the hole being cut is at right angles to the putting surface. When the cutting tool is being retracted, the portion of the base 16 which is contiguous to the opening 18 substantially prevents any upward movement of the earth surrounding the hole and thereby prevents the formation of any ridge adjacent to the lip of the hole.

Figure 3:
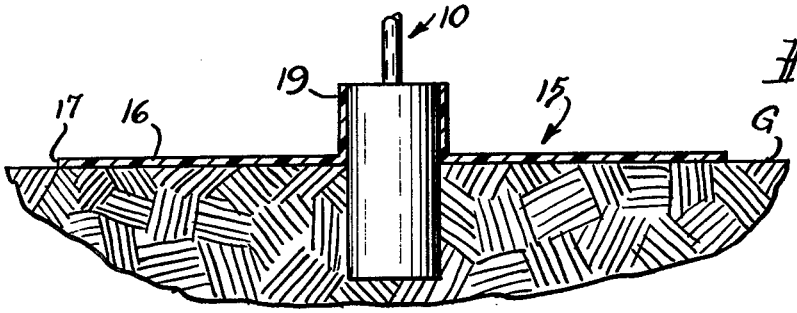
FIG. 3 is a sectional view similar to FIG. 2 showing the extent of penetration of the hole cutter.

As illustrated best in FIG. 3, the length of the sleeve 19 is determined by the length of the cutter 11 so that when the upper edge of the cutter is even with the upper edge of the sleeve 19, the lower edge of the cutter is located approximately 5 inches (127.00 mm) below the putting surface.

It is contemplated that the upper edge of the cutter 11 may have an outwardly extending lip or stop which engages the upper edge of the sleeve 19 after the cutter has penetrated a desired amount to limit the penetration of the cutter 11.

In the operation of the device, when it is desired to move the cup of a golf green, the greenskeeper selects a desired location and places the cutter guide of the present invention on the green G. The greenskeeper stands on the base 16 and inserts the cutter tool 10 into the sleeve 19 until the cutter 11 rests on the putting surface. The greenskeeper applies a downward force either by pushing on the handle 13 or stepping on the upper portion of the cutter 11 to force the cutter into the green. If desired the greenskeeper may rotate the cutter tool to assist in penetrating the earth. The cutter tool is forced downwardly until the upper edge of the cutter 11 is substantially in alignment with the upper edge of the sleeve 19 after which the cutter tool is retracted and removes a plug of earth to form a hole having a predetermined depth.

Thereafter the cup is removed from the previous hole and is inserted into the new hole and the cutter then is inserted into the previous hole and is retracted while the plug of earth is discharged therefrom to fill the previous hole. Since the depth of the previous hole and the new hole are substantially identical, the plug of earth fills the previous hole exactly so that the grass of the plug of material is substantially planar with the remainder of the putting surface. The cutter guide prevents any marking by the shoes of the greenskeeper as well as prevents any ridge being formed when the cutter is extracted from the hole. This is particularly important since the holes are normally relocated in the early morning when the greens may be soggy from dew or from watering.

I claim:

1. Apparatus for positioning a golf cup on a golf green comprising a guide member and a cutter tool, said guide member including a flat generally circular base having an upper surface of a size to support a person thereon, a guide sleeve having a first end integrally connected to said base and extending axially upwardly so that a second end is located at a predetermined height, said guide sleeve having an inner peripheral diameter which is substantially similar to the outer diameter of the golf cup, said cutter tool including an elongated tubular member having first and second ends and an outer diameter which is substantially the same as the diameter of the golf cup, the length of said tubular member being greater than the combined length of said guide sleeve and the golf cup, said tubular member being substantially hollow and unobstructed from said first end to said second end, an elongated rod connected to said second end of said tubular member and extending axially away from the same, a handle fixed to the end of said rod remote from said tubular member, said tubular member being slidably received by said guide sleeve, and said first end of said tubular member caused to penetrate a golf green until said second end of said tubular member is substantially level with said second end of said guide sleeve, whereby a plug of earth may be removed from the green leaving an opening of a size to receive a golf cup and said circular base prevents the formation of a ridge around the opening when the plug is removed.

* * * * *